US005582297A

United States Patent [19]

Carter

[11] Patent Number: 5,582,297

[45] Date of Patent: Dec. 10, 1996

[54] PACKAGING

[75] Inventor: Matthew F. Carter, Auckland, New Zealand

[73] Assignee: Squire Corporation Limited, Auckland, New Zealand

[21] Appl. No.: 264,742

[22] Filed: Jun. 23, 1994

[51] Int. Cl.[6] ..... B65D 85/30; B65D 85/32

[52] U.S. Cl. ..... 206/521.1; 206/521.3; 206/503; 206/509; 206/511

[58] Field of Search ..... 206/521.1, 521.3, 206/509, 508, 511; 220/4.22, 4.23, 508

[56] References Cited

U.S. PATENT DOCUMENTS

| | | | |
|---|---|---|---|
| 2,971,685 | 2/1961 | Treida | 206/521.1 |
| 3,351,270 | 11/1967 | Hohnjec | 206/521.1 |
| 3,371,712 | 11/1973 | Richards | 206/521.1 |
| 3,986,299 | 10/1976 | Merzweiler | 206/521.1 |
| 4,492,331 | 1/1985 | Bixler et al. | 206/521.1 |
| 4,650,076 | 3/1987 | Padovani | 206/521.1 |
| 5,205,410 | 4/1993 | Kuipers et al. | 206/521.1 |

*Primary Examiner*—David T. Fidei
*Attorney, Agent, or Firm*—Foley & Lardner

[57] ABSTRACT

This invention relates to the provision of a package having interengaging members which, when engaged with similar such members, nest within each other. Load applied to the top of such a package is transferred down an interengaging member into a similar interengaging member on the base and further to a similar interengaging member on a package below. A stack of such packages will allow the load of the stack to be transferred directly through the interengaging members to the support base on which the stack resides.

4 Claims, 3 Drawing Sheets

PACKAGING

BACKGROUND TO THE INVENTION (i) Field of the Invention

The present invention relates to improvements in and relating to packaging.

More particularly, but not exclusively, the present invention relates to packaging for perishable items, such as kiwifruit.

(ii) Description of the Prior Art

Numerous different types of packaging products specifically designed for transporting produce are available. Many are custom designed for carrying a specific item such as kiwifruit, because of the fruit's individual requirements.

When perishable items are transported damage to the items will very often occur whilst in transit, if the necessary support for the items is not provided. Produce may have to be dumped because it has been marked as a result of the way in which it has been packed, with export dollars being lost which could have been avoided if suitable packaging had been used.

OBJECT OF THE INVENTION

It is therefore an object of the present invention to go some way to providing packaging which attempts to obviate the disadvantages referred to above, or to at least provide the public with a useful choice.

Further objects of the present invention will become apparent from the following description.

SUMMARY OF THE INVENTION

According to one aspect of this invention there is provided a packaging means including an article receiving portion, said packaging means having at least one inter-engaging member thereon, said member at least partially defining on one side thereof a recess to receive a corresponding inter-engaging member located on a second packaging means and on an opposite side to substantially engage in a recess on a third engaging means, inter-engagement of said members being substantially frictional such that when said like packaging means are stacked, said inter-engaging members frictionally inter-engage one with the other to support said packaging means in a substantially predetermined relationship.

According to a further aspect of this invention there is provided a packaging means wherein portions of said inter-engaging members are correspondingly tapered such that tapered opposing faces of said inter-engaging members and recesses frictionally engage one with the other when stacked.

According to a still further aspect of this invention there is provided a packaging means comprising an article receiving portion having a plurality of pockets and an encasing portion, with each of said portions being provided with at least one inter-engaging member, said inter-engaging member of one of said portions being recessed to receive a corresponding inter-engaging member located on said second portion such that the inter-engaging member of one portion frictionally engages with a corresponding inter-engaging member on said second portion so that when like packaging means are stacked, at least one of said inter-engaging members of one packaging means receives a corresponding inter-engaging member of a second packaging means in a stack, such that an inter-engaging member of one packaging means frictionally engages an inter-engaging member of a second packaging means.

BRIEF DESCRIPTION OF THE INVENTION

Further aspects of this invention which should be considered in all its novel aspects, will become apparent from the following description given by way of example of a possible embodiment thereof and in which reference is made to the accompanying drawings wherein:

FIG. 1: Shows diagrammatically in plan view a packaging means according to one possible embodiment of the invention.

FIG. 2: Shows a cross-sectional view along arrows A—A shown in FIG. 1.

FIG. 3: Shows a cross-sectional view along arrows B—B of FIG. 1.

FIG. 4: Shows a cross-sectional view along arrows C—C of FIG. 1.

FIG. 5: Shows a cross-sectional view through one packaging means as seen when taken at an angle such as that of line C—C when the two portions of the packaging means are overlaid.

FIG. 6: Shows a cross-sectional view through two packaging means according to one possible embodiment of the invention which have been stacked.

DETAILED DESCRIPTION OF THE PREFERRED EMBODIMENT

The present invention relates to a packaging means which in one embodiment thereof is particularly suitable for use in packing kiwifruit. However, it is to be appreciated that the present invention has applications wherever packaging trays are required for transporting other perishable items.

Referring to the accompanying drawings, the packaging means according to one possible embodiment of the invention is shown diagrammatically. It is seen to include two portions, an article receiving portion referenced generally by Arrow 1 and an encasing portion referenced generally by Arrow 2. The two portions 1, 2 of the packaging tray as shown in the present embodiment may be joined and may be folded one on top of the other, at a fold line referenced generally by Arrow 3. Alternatively, the two portions 1, 2 may be separate trays.

Also, the hinge provided by fold line 3 may be provided on any desired edge of the packaging tray.

The article receiving portion 1 may have a plurality of recesses, such as pockets 4 for receiving an article to be packed. The arrangement of pockets 4 shown in the present embodiment consists of parallel rows of pockets 4. Alternatively, the pockets 4 may be arranged in a staggered or other configuration.

Figure 1:
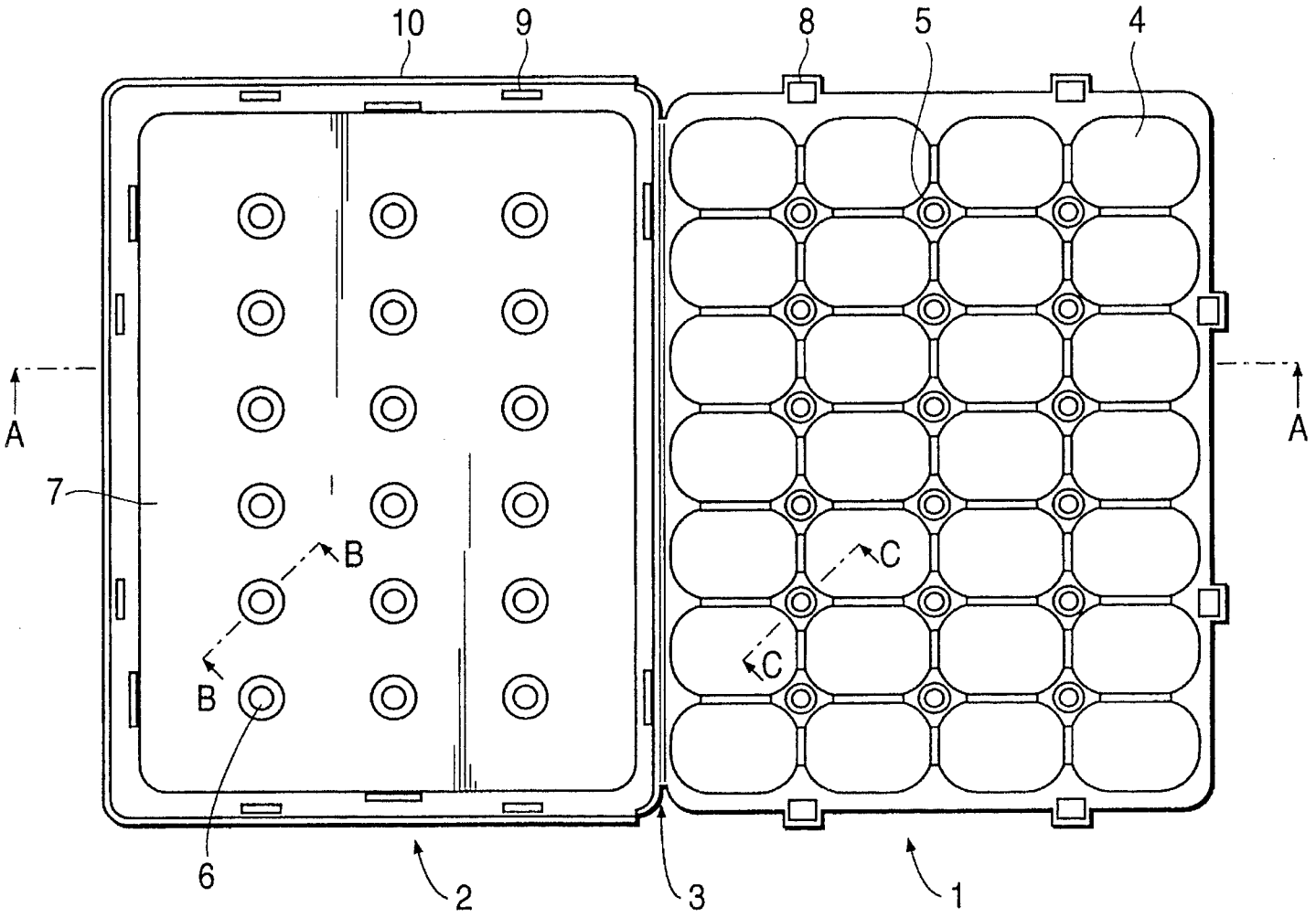

In the present embodiment, where four pockets converge, an inter-engaging member 5 may be located where the ends of four pockets 4 converge. In the case of the present embodiment the pockets 4 are elongate in shape and this is evident from the plan view of the packaging means, as shown in FIG. 1. The shape of the pockets 4 may of course vary depending on the article being packed.

In the present embodiment the encasing portion 2 consists of a series of inter-engaging members 6 aligned in a series of rows. The rows of inter-engaging members 6 located on the encasing portion 2 may be positioned so as to correspond with the placement of inter-engaging members 5 located on the article receiving portion 1 of the packaging tray. It is also to be appreciated that there may not be a corresponding inter-engaging member for each inter-engaging member on one portion.

The encasing portion 2 of the packaging tray as shown in the present embodiment, has a raised flat surface 7 from which the inter-engaging members 6 extend. It is to be appreciated that instead of a flat surface, the encasing portion may also be shaped to fit the contours of the articles being packed in the tray.

When a tray has been packed, the encasing portion 2 may act as a lid and is folded along the fold line 3, with the lid being brought down over the article receiving portion 1. The inter-relationship between the inter-engaging members 5, 6 is explained in detail later in the patent specification, suffice to say at this point, that the inter-engaging member of one portion frictionally engages with an inter-engaging member of the second portion.

The article receiving portion 1 may have a further securing means, such as a tab 8 positioned at intervals along the perimeter of the article receiving portion 1. When the lid 2 is folded over to lie on top of the article receiving portion 1, the tabs 8 may engage a corresponding projection 9 situated on the inside of the lid 2 to hold the lid 2 in place. The free edges of the lid 2 may as in the present embodiment overhang the article receiving portion 1.

Figure 2:
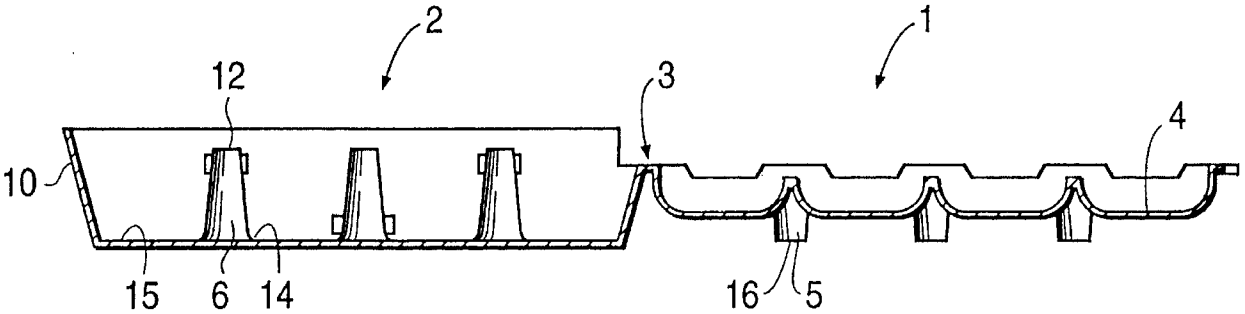

FIG. 2 shows a sectional view of the packaging tray taken through the line depicted by arrow A—A, as shown in FIG. 1. In this Figure a side view of the inter-engaging members 5, 6 is shown. In the present embodiment the inter-engaging members 5, 6 consist of a tapered hollow member. In the present embodiment the end portion 12 of the inter-engaging member 6, of the type located on the lid 2, is narrow at the apex and is wider at the base portion 14, which connects with the interior surface of the lid 2. The inter-engaging member 5 of the type located on the article receiving portion 1 may extend beyond the bases of the pockets 4, tapering at its apex 16. The inter-engaging members 5 of the article receiving portion 1 may support the article receiving portion 1 of the packaging tray when resting on a flat surface.

Figure 4:
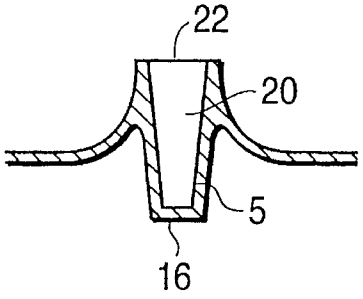
Figure 3:
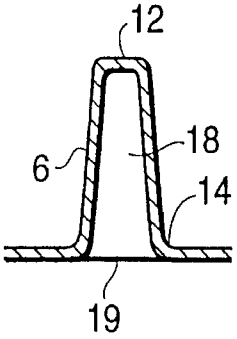

In FIGS. 3 and 4 a cross-sectional view through the inter-engaging members 5 and 6 of the present embodiment is shown, each one being peculiar either to the article receiving portion 1 or the lid 2, in the present embodiment. In FIG. 3 an inter-engaging member of the type present on the lid 2 is shown. The inter-engaging member 6 is shown with a flat portion 12 at its apex, with a cavity 18 and a aperture 19. It is to be appreciated, however, that the inter-engaging member 6 may be open at both ends. In FIG. 4 an example is shown of an inter-engaging member 5 located on the article receiving portion 1 of the packaging tray. Here again, there is a flat portion 16 at the apex of the inter-engaging member 5, with a cavity 20 and an aperture 22. As with the inter-engaging member 6, both ends of the inter-engaging member 5 may also be open at both ends.

The apparatus as shown in FIGS. 3 and 4 shows cavities 18 and 20 extending the full depth of the inter-engaging members 6 and 5. Due to the method of engagement, the cavities 18 and 20 may terminate in a thickened solid end for extra strength or rigidity if required.

Figure 5:
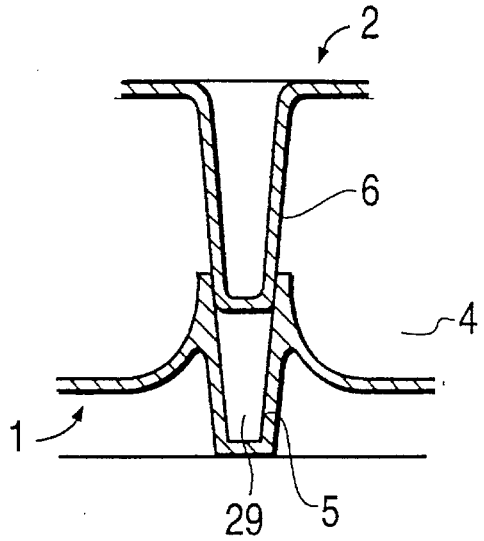

In FIG. 5 the inter-engaging members 5, 6 of the article receiving portion 1 and the lid 2 are shown engaged, the lid 2 having been brought down onto the top surface of the article receiving portion 1. In the present embodiment, for every inter-engaging member 5 located on the article receiving portion 1, there is a corresponding inter-engaging member 6 located on the lid 2. The arrangement is such that the inter-engaging member 6 of the lid 2 may come to rest in the cavity 20 of the corresponding inter-engaging member 5 of the article receiving portion 1. The tapered portion of the inter-engaging member 6 is of a smaller diameter than that of the diameter of the aperture 22 of the corresponding inter-engaging member 5 of the article receiving portion 1. A section of the inter-engaging member 6 may be in contact with the inter-engaging member 5 of the article receiving portion 1. However, in the present embodiment, the inter-engaging member 6 extends only part way into the cavity 20 leaving a space between the flat portion 12 of the inter-engaging member 6 and that of the flat portion 16 of the inter-engaging member 5 of the article receiving portion 1. In this way the inter-engaging members frictionally engage one and other at their sides, with the load thus being transferred to the sides of the pockets, for distribution throughout the tray, as opposed to the load being centred at a point, thus increasing the surface area for accommodating the load.

In this manner, the bearing surface of the engagement is increased to decrease the bearing pressure and thereby allowing relatively narrow engagement members to carry the load.

Figure 6:
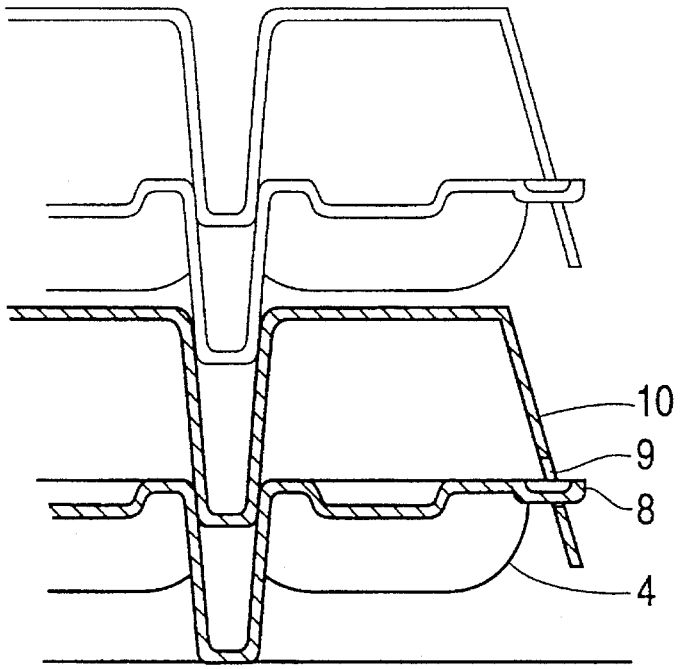

In FIG. 6 two packaging trays are shown in a stacked arrangement with the inter-engaging members 5, 6 of one packaging tray in contact with that of the packaging tray below and above. In this embodiment of the invention the bases of the pockets 4 do not rest on the exterior surface of the lid 2 and thereby applying downward pressure. Instead the inter-engaging members 5, 6 serve to hold the packaging trays in an arrangement whereby the space of one packaging tray and the top surface of the tray below in a stack is determined by the area of the inter-engaging member in contact with the inter-engaging member below. The fit is such of the inter-engaging members 5, 6, that a stack of packaging trays may be held in a fixed arrangement with the inter-engaging members 5, 6 forming columns and adding to the stability of the stack whilst distributing the load more evenly.

It is to be appreciated that the present invention may be constructed out of various types of materials, however, paper pulp is one particularly suitable material for the manufacture of the present invention. The present invention means that pocket pack liners and additional packaging often required with known packaging are no longer necessary with the present invention.

Where in the foregoing description reference has been made to specific components or integers of the invention having known equivalents then such equivalents are herein incorporated as if individually set forth.

Although this invention has been described by way of example and with reference to possible embodiments thereof it is to be understood that modifications or improvements may be made thereto without departing from the scope of the invention as defined in the appended claims.

I claim:

1. A package for the packaging of articles comprising:

a base portion containing a plurality of article receiving portions;

a lid portion encasing articles placed within said base portion;

plurality of inter-engaging members formed on said article receiving portions, each member having a first and a second end, each member being provided with a taper on the external circumference thereof at least over a region adjacent said first end;

a recess provided within said second end of each of said inter-engaging members defined by at least one side wall, said side wall having a tapered internal circumference which substantially corresponds with the tapered external circumference of the region adjacent said first end of each member such that said first end of a similar inter-engaging member may nest within the recess;

said lid portion being provided with co-operating inter-engaging portions which engage with said inter-engaging members on said base portion, said inter-engaging portions on said lid portion engaging with corresponding members on a package above when placed in a vertical stack of such packages, and said inter-engaging members on said base portion inter-engaging with inter-engaging portions on a lid portion of a package below;

whereby a substantial portion of the weight of the upper package is passed to the lower package through a bearing surface provided by contact between the tapered external circumference region adjacent said first end of an inter-engaging member on one of said packages and at least a portion of said side wall defining the recess of an inter-engaging member on an adjacent package.

2. A package for the packaging of articles as claimed in claim 1, wherein said inter-engaging members on said base portion are provided about or between said article receiving portions.

3. A package for the packaging of articles as claimed in claim 2, wherein said plurality of article receiving portions are arranged in said base portion in a substantially horizontal planar arrangement.

4. A package as claimed in claim 3, wherein said article receiving portions are sized and configured for the containment of kiwifruit.

* * * * *